United States Patent [19]

Kobayashi

[11] Patent Number: 4,708,347

[45] Date of Patent: Nov. 24, 1987

[54] CLUB-HEAD

[75] Inventor: Masashi Kobayashi, Matsudo, Japan

[73] Assignee: Maruman Co., Ltd., Tokyo, Japan

[21] Appl. No.: 854,626

[22] Filed: Apr. 22, 1986

[30] Foreign Application Priority Data

Apr. 27, 1985 [JP] Japan ..... 60-089908

[51] Int. Cl.[4] ..... A63B 53/04

[52] U.S. Cl. ..... 273/171; 273/78

[58] Field of Search ..... 273/169, 171, 172, 173, 273/174, 78, 167 J, 167 A, 177 J

[56] References Cited

U.S. PATENT DOCUMENTS

| | | | |
|---|---|---|---|
| 1,473,528 | 11/1923 | Tootle | 273/169 |
| 1,567,248 | 12/1925 | Dahlman | 273/169 |
| 1,678,637 | 7/1928 | Drevitson | 273/169 |
| 1,988,043 | 1/1935 | Lard | 273/169 |
| 3,260,525 | 7/1977 | Ortel | 273/171 X |
| 4,063,737 | 12/1977 | Tom et al. | 273/174 |
| 4,540,178 | 9/1985 | Johnson et al. | 273/169 |
| 4,630,827 | 12/1986 | Yoneyama | 273/169 |

FOREIGN PATENT DOCUMENTS

| | | | |
|---|---|---|---|
| 59-16670 | 2/1984 | Japan | 273/169 |

*Primary Examiner*—George J. Marlo

*Attorney, Agent, or Firm*—Armstrong, Nikaido, Marmelstein & Kubovcik

[57] ABSTRACT

A club-head for a golf club includes a hitting portion (11) and a hosel portion (12). The hitting portion (11) comprises a main body (13) made of a fiber-reinforced plastic. A metal sold member (14) is integrally fixed to the under surface of the main body (13). A weight member (18) made of a heavy material such as a heavy metal and formed separately from the sole member (14) is inserted into the main body (13). The weight member (18) is rigidly connected to the sole member (14) by means of connecting members (19) formed separately from at least one of the sole member (14) and the weight member (18).

8 Claims, 8 Drawing Figures

CLUB-HEAD

BACKGROUND OF THE INVENTION

1. Field of the Invention

The present invention relates to a club-head for a golf club, more particularly, to an improvement of a club-head having a hitting portion which includes a main body made of a fiber-reinforced plastic and a metal sole member integrally fixed to the main body along the underside of the main body.

2. Description of the Related Arts

A known club-head has a hitting portion which consists of a main body made of a fiber-reinforced plastic and a metal sole member integrally fixed to the main body along the underside of the main body. In such a club-head, the main body made of a fiber-reinforced plastic defines the front and back surfaces of the hitting portion, and the sole member defines the sole surface thereof. Generally, since a club-head having such a construction has a weight less than that of a head made of only metal, a kinetic energy transmitted from a plastic/metal head to a golf ball, when striking the golf ball, tends to be smaller than that transmitted from an all-metal head to the golf ball, resulting in a short flight or run of the ball. Further, such a club-head including a main body made of a fiber-reinforced plastic has a drawback in that, when striking a ball, the main body is distorted due to the impact of the ball thereon, resulting in a deterioration of the direction of flight or run of the ball.

Japanese patent application No. 60-62133 discloses a club-head for a golf club for eliminating the above-mentioned drawbacks, in which the club-head comprises a weight member made of a heavy material and attached either on the backside or in the interior of the main body made of a fiber-reinforced plastic. When the weight member is attached on the backside of the main body, however, the club-head has a drawback in that the weight member is apt to be exfoliated from the main body upon impact with a golf ball. When the weight member is arranged in the interior of the main body, however, the club-head has a drawback in that it is difficult to properly locate the weight member in place in the main body when molding the main body, making it difficult to produce the club-head. Further, in these kinds of club-heads, the main body is apt to be exfoliated from the sole member upon impact with a golf ball.

SUMMARY OF THE INVENTION

Accordingly, it is an object of the present invention to provide a club-head which can prevent exfoliation of the weight member made of a heavy material from the main body made of a fiber-reinforced plastic and exfoliation of the steel sole member from the main body, and which can be easily produced.

The object of the present invention can be achieved by the provision of a club head for a golf club including a hitting portion having a front surface for striking a golf ball, a back surface, a sole surface, and heel and toe ends, and a hosel portion extending obliquely upward from the heel end of the hitting portion, the hitting portion comprising: a main body made of fiber-reinforced plastic defining at least the front and back surfaces of the hitting portion; a metal sole member integrally fixed to the main body along the underside of the main body and defining the sole surface of the hitting portion; a weight member made of a heavy material arranged in the main body behind the front surface of the hitting portion and formed separately from the sole member; and at least one or more connecting members formed separately from at least one of the sole member and the weight member and arranged in the main body for rigidly connecting the weight member with the sole member.

Since the weight member of the club-head according to the present invention is rigidly connected to the sole member by the connecting member(s), it is possible to prevent exfoliation of the weight member from the main body and of the sole member from the main body. Further, it is easy to locate the weight member in place in the main body when the main body is formed by molding and, therefore, the club-head according to the present invention can be easily produced.

BRIEF EXPLANATION OF THE DRAWINGS

The foregoing and other objects and advantages of the present invention will be better understood from the following description with reference to the preferred embodiments illustrated in the drawings; wherein.

DESCRIPTION OF THE PREFERRED EMBODIMENTS

Figure 1:
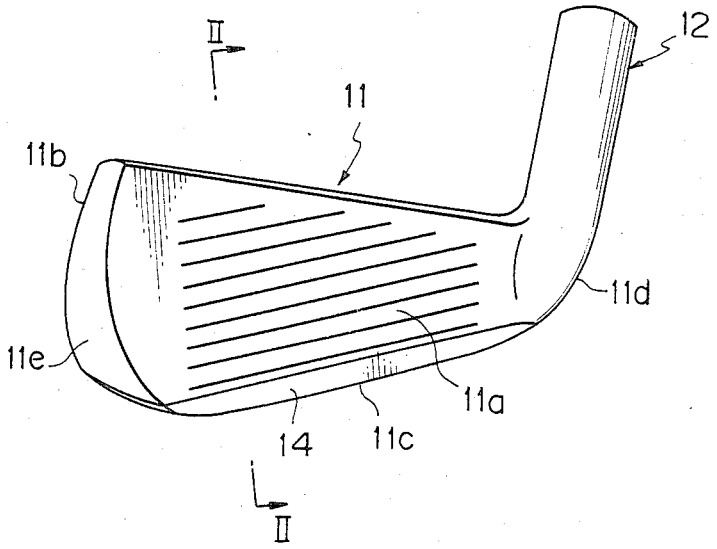
FIG. 1 is a perspective view of the club-head according to one embodiment of the present invention.
Figure 2:
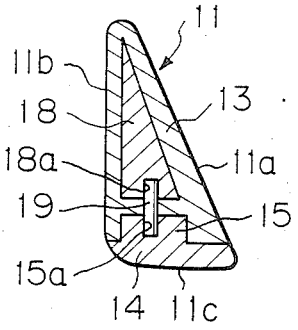
FIG. 2 is a sectional view taken along the line II—II of FIG. 1.
Figure 3:
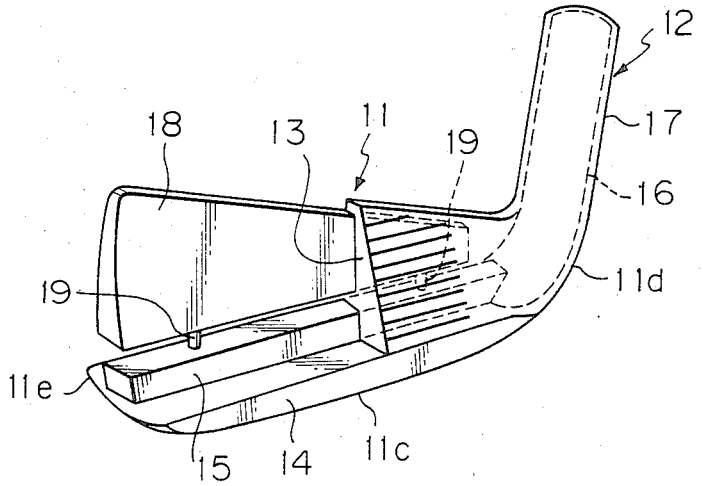
FIG. 3 is a partially broken-away perspective view of the club-head shown in FIG. 1.
Figure 4:
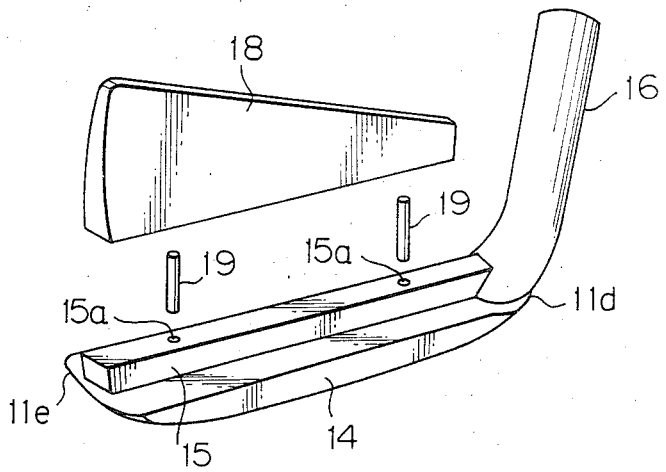
FIG. 4 is an exploded perspective view of the main parts of the club-head shown in FIG. 1.

FIGS. 1 through 4 illustrate a first embodiment of the present invention applied to a club-head for an iron golf club. Referring to FIGS. 1 to 4, the club-head comprises a hitting portion 11 and a neck or hosel portion 12. The hitting portion 11 has a front surface 11*a* for striking a golf ball (not shown), a back surface 11*b*, a sole surface 11*c*, a heel end 11*d*, and a toe end 11*e*. The hosel portion 12 extends obliquely upward from the heel end 11*d* of the hitting portion 11.

The hitting portion 11 comprises a main body 13 which, in this embodiment, defines the front and back surfaces 11*a* and 11*b* and the heel and toe ends 11*d* and 11*e*. The main body 13 is made of a fiber-reinforced plastic, such as a plastic reinforced by carbon fibers or glass fibers. The plastic may be mixed with whiskers and/or an amorphous alloy to further improve the strength thereof.

A sole member 14 for defining the sole surface 11*c* of the hitting portion 11 is integrally fixed to the main body 12. The sole member 14 extends along the underside of the main body 13 between the heel end 11*d* and the toe end 11*e* of the hitting portion 11. The sole member 14 is made of a metal, such as iron, stainless steel, brass, aluminum alloy, or titanium alloy. The upper surface of the sole member 14 is formed integrally with a ridge 15 for improving the strength of the connection between the main body 13 and the sole member 14. The ridge 15 extends between the heel end 11*d* and the toe end 11*e* of the hitting portion 11. The height of the top end of the ridge 15 from the sole surface 11*c* of the hitting portion 11 is approximately 10 to 14 millimeters at most and is less than the height of the center of the front surface 11*a* of the hitting portion 11.

The hosel portion 12 comprises a metal core 16 made of the same material as that of the sole member 14 and formed integrally with the sole member 14. The metal core 16 has at the top end thereof a hole (not shown) for receiving the tip end of a club shaft (not shown). The outer periphery of the metal core 16 is enveloped with the outer cover 17 which is made of the same material as that of the main body 13 and formed integrally with the main body 13.

A weight member 18 formed separately from the sole member 14 is embedded into the main body 13 behind the front surface 11*a* of the hitting portion 11. The weight member 18 is, in this embodiment, wholly enveloped by the main body 13 and thus cannot be seen from outside the hitting portion 11. The weight member 18 has a bottom surface which is located above the upper surface of the sole member 14 to define a gap therebetween, which gap is filled with the fiber-reinforced plastic of the main body 13. The weight member 18 is made of a heavy material, such as stainless steel, brass, aluminum alloy, titanium lead, or epoxy resin mixed with a metal powder.

The weight member 18 is rigidly connected to the sole member 14 by means of two supports or connecting members 19 having a pin shape. Each connecting member 19 extends through the main body 13 between the weight member 18 and the ridge 15 of the sole member 14. Further, each connecting member 19 is, in this embodiment, formed separately from the sole member 14 and the weight member 18 and fitted at the opposite ends thereof into holes 15*a* and 18*a* formed in the upper surface of the ridge 15 of the sole member 14 and the bottom surface of the weight member 18, respectively. Alternately, a hole for receiving the lower end of the connecting member 19 may be formed in the upper surface of the sole member 14. The connecting members 19 may be made of a metal, fiber-reinforced plastic or the like, and may be bonded to the weight member 18 and the ridge 15 of the sole member 14 by adhesives or the like.

According to the club-head having the above-described construction, the weight member 18 can be rigidly connected to the metal sole member 14 by means of the rigid connecting members 19, and thus the main body 13 can be firmly supported on the sole member 14 and on the weight member 18. The position of the center of gravity of the club-head can be defined in any place, even in the height direction and in the thickness direction, in the club-head by a selection of combinations of the material composing the sole member 14 and weight member 18, having various specific weights. Further, the center of gravity of the club-head also can be easily adjusted even in the height direction and in the thickness direction by varying the distance between the weight member 18 and the backside surface of the main body 13 or the upper surface of the sole member 14 during the molding of the club-head.

Since the weight member 18 has a density which is higher than that of the main body 13, it serves to increase a kinetic energy applied to a golf ball when the ball is hit by the club-head, which results in an increase of the distance of the flight or run of the golf ball. The weight member 18 also serves, in cooperation with the sole member 14, to reduce the distortion of the main body when the club-head strikes a golf ball, whereby the direction of flight or run of the golf ball is improved.

The main body 13 can be formed in such a manner that the fiber-reinforced plastic is fed into a mold (not shown) having therein a cavity which corresponds to a configuration of the club-head and in which cavity the metal sole member 14 with the metal core 16 of the hosel portion 12 and the weight member 18 connected to the sole member 14 via the connecting members 19 are previously disposed. Consequently, the weight member 18 can be easily located in place in the main body 13, and thus the club-head can be easily produced.

FIGS. 5 through 8 show alternative embodiments, respectively, of the club-head according to the present invention. In these Figures, constituents of the club-head corresponding or similar to those of the above-described embodiment are denoted by the same reference numerals as those used in FIGS. 1 to 4, respectively.

Figure 5:
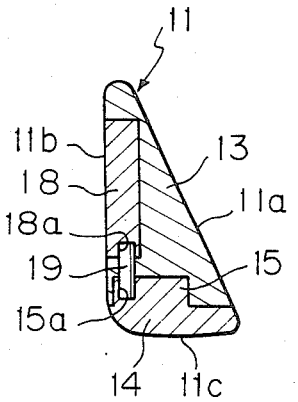
FIGS. 5 through 8 are sectional views of the club-head illustrating other embodiments of the present invention, respectively, and corresponding to FIG. 2.

In the club-head shown in FIG. 5, the weight member 18 is partially embedded in the main body 13 of the hitting portion 11 in such a manner that the back surface of the weight member 18 is exposed outside the main body 13, to define a part of the back surface 11*b* of the hitting portion 11 of the club-head. The connecting pins 19 extend through the main body 13 between the weight member 18 and the ridge 15 of the sole member 14, and at the opposite ends thereof, are fitted into the weight member 18 and the ridge 15 of the sole member 14. In this embodiment shown in FIG. 5, since the weight member 18 is located nearest the back surface 11*b* of the hitting portion 11 of the club-head, it is possible to increase the distance between the position of center of gravity of the club-head and the front surface 11*a* of the hitting portion 11. Consequently, the direction of flight of the golf ball struck at a position outside the "sweet spot" of the front surface 11*a* of the hitting portion 11 is improved by an increase of the known "gear action" produced between the hitting portion 11 and the golf ball.

Figure 6:
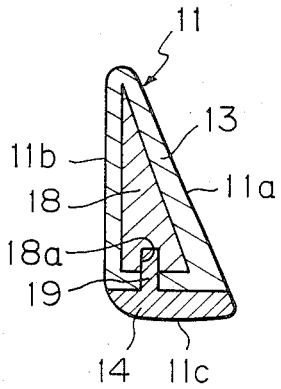

In the embodiment shown in FIG. 6, the connecting member 19 is made of the same metal as that of the sole member 14 and formed integrally therewith. The connecting member 19 extends upward from the upper surface of the sole member 14 through the main body 13 and is fitted at the top end thereof into the hole 18*a* formed in the weight member 18. The ridge formed on the sole member of the aforementioned embodiments is omitted from the sole member 14 of the embodiment shown in FIG. 6. According to this embodiment, the number of elements used for the club-head can be reduced due to integration of the connecting member 19 with the sole member 14.

Figure 7:
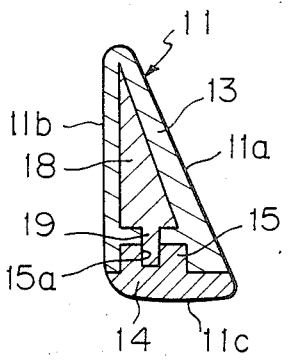

In the embodiment shown in FIG. 7, the connecting member 19 is made of the same metal as that of the weight member 18 and formed integrally therewith. The connecting member 19 extends downward from the bottom surface of the weight member 18 through the main body 13 and is fitted at the lower end thereof into the hole 15*a* formed in the ridge 15 of the sole member 14. According to this embodiment, the number of elements used for the club-head can be reduced due to integration of the connecting member 19 with the weight member 18.

Figure 8:
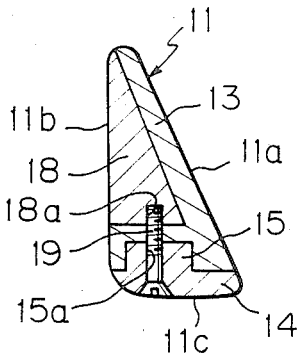

In the embodiment shown in FIG. 8, the back surface of the weight member 18 is exposed outside the main body 13 to define a part of the back surface 11*b* of the hitting portion 11. Further, in this embodiment, a screw 19 as the connecting member extends through the sole member 14 and the main body 13 between the sole member 14 and the weight member 18 and is screwed into the threaded hole 18*a* formed in the weight member 18. According to this embodiment, the weight member 18 can be easily and delicately adjusted to any height from the sole member 14 by adjusting the amount of screwed portion between the weight member 18 and the screw 19 before molding the main body 13. Consequently, the position of the center of gravity of the club-head can be easily and delicately adjusted.

While particular embodiments shown in the Figures and disclosure of the present invention have been described, it will be understood, of course, that the present invention in not limited thereto, since modifications can be made by those skilled in the art in the light of the foregoing teachings. For example, the weight member may be divided into a plurality of sections; the weight member may have therein a cavity or apertures extending therethrough in the direction of thickness thereof; and the connecting member may be a plate-like member extending between the heel and toe ends of the hitting portion in the main body. In this case, the sole member and/or the weight member may be formed with a groove for engaging with such a plate like member. Further, the present invention may be applied to not only a club-head for an iron golf club, as in the foregoing embodiments, but also to other gold clubs, such as a putter.

Accordingly, the appended claims cover any such modifications which may incorporate those features which come within the true spirit and scope of the present invention.

I claim:

1. A club-head for a golf club, including a hitting portion having a front surface for striking a golf ball, a back surface, a sole surface, a top edge and heel and toe ends, and a hosel portion extending obliquely upward from said heel end of said hitting portion, said hitting portion comprising:

a main body made of fiber-reinforced plastic for defining at least said front and back surfaces of said hitting portion;

a metal sole member integrally fixed at an upper surface thereof to said main body along the underside of said main body for defining said sole surface of said hitting portion;

a weight member made of heavy material and arranged in said main body behind said front surface of said hitting portion and formed separately from said sole member, said weight member having a top edge and front, back and bottom surfaces, said top edge of said weight member being located in the vicinity of said top edge of said hitting portion, said bottom surface of said weight member being located apart from said upper surface of said metal sole member so that a part of said main body is disposed between said weight member and said metal sole member, said front surface of said weight member extending substantially in parallel to said front surface of said hitting portion so that said main body has substantially a constant thickness between said front surface of said hitting portion and said front surface of said weight member;

at least one or more connecting members, rigidly connecting said weight member with said metal sole member, formed separately from at least one of said sole member and weight member and extending between said bottom surface of said weight member and said upper surface of said metal sole member through said main body.

2. A club-head according to claim 1, wherein said connecting members are fitted at the opposite ends thereof into holes or grooves formed in said weight member and sole member, respectively.

3. A club-head according to claim 1, wherein said connecting members are formed integrally at one end thereof with one of said weight member and said sole member, and the other end thereof is fitted into holes or grooves formed in another one of said weight member and said sole member.

4. A club-head according to claim 1, wherein said connecting members are screws extending through said sole member and screwed into threaded holes formed in said weight member.

5. A club-head according to claim 1, wherein said sole member is formed with a ridge extending along the upper surface thereof between said heel and toe ends of said hitting portion.

6. A club-head according to claim 1, wherein said weight member is positioned in the interior of said main body so as to be covered by said main body.

7. A club-head according to claim 1, wherein said weight member is partially exposed outside said main body so as to define a part of said back surface of said hitting portion.

8. A club-head according to claim 1, wherein said hosel portion comprises a metal core which is formed integrally with said sole member, and an outer cover made of fiber-reinforced plastic and which surrounds said metal core and is formed integrally with said main body of said hitting portion.

* * * * *